US008251149B2

(12) United States Patent
Anter

(10) Patent No.: US 8,251,149 B2
(45) Date of Patent: Aug. 28, 2012

(54) METHOD AND APPARATUS TO TRANSPORT SUBTERRANEAN OIL TO THE SURFACE

(76) Inventor: Michael D Anter, Glendale, AZ (US)

( * ) Notice: Subject to any disclaimer, the term of this patent is extended or adjusted under 35 U.S.C. 154(b) by 324 days.

(21) Appl. No.: 12/584,179

(22) Filed: Aug. 31, 2009

(65) Prior Publication Data

US 2011/0048730 A1 Mar. 3, 2011

(51) Int. Cl.
*E21B 43/00* (2006.01)

(52) U.S. Cl. ..... 166/369; 417/246

(58) Field of Classification Search ..... 166/369, 166/68, 68.5, 72, 105, 107; 417/62, 269, 417/244, 254, 249, 246
See application file for complete search history.

(56) References Cited

U.S. PATENT DOCUMENTS

| | | | | |
|---|---|---|---|---|
| 4,661,046 | A * | 4/1987 | Ruyle | 417/203 |
| 4,819,348 | A * | 4/1989 | DeBolt | 37/350 |
| 4,971,526 | A * | 11/1990 | Ruyle | 417/244 |
| 5,174,725 | A * | 12/1992 | Guile et al. | 417/205 |
| 6,170,667 | B1 * | 1/2001 | Bilak et al. | 209/3 |
| 6,406,277 | B1 * | 6/2002 | Shafer et al. | 417/424.2 |
| 6,439,311 | B2 * | 8/2002 | Haseloh | 166/311 |
| 7,461,692 | B1 * | 12/2008 | Wang | 166/105.5 |
| 8,007,254 | B2 * | 8/2011 | LaRose et al. | 417/356 |

* cited by examiner

*Primary Examiner* — Shane Bomar
*Assistant Examiner* — Kipp Wallace
(74) *Attorney, Agent, or Firm* — Tod R. Nissle, P.C.

(57) ABSTRACT

A method to extract oil for a pool of oil in the ground utilizes an interconnected series of rotating helical blades extending from the surface of the ground through a canted bore to the pool of oil. The blades can be staggered and interconnected with a gear arrangement that moves oil from pool to pool and up to the surface of the ground.

1 Claim, 3 Drawing Sheets

METHOD AND APPARATUS TO TRANSPORT SUBTERRANEAN OIL TO THE SURFACE

This invention relates to systems for extracting subterranean oil.

More particularly, the invention relates to an improved system to move oil from a subterranean pool upwardly through a slanted bore to the surface of the ground.

A long existing motivation in connection with removing petroleum reserves from the ground comprises developing new systems and technologies to maximize the quantity of oil which can be removed from an oil field.

Accordingly, it would be highly desirable to provide an improved process for extracting oil from the ground.

Therefore it is a principal object of the invention to provide an improved oil extraction method and apparatus.

This and other, further and more specific objects of the invention will be apparent to those skilled in the art from the following detailed description thereof, taken in conjunction with the drawings, in which.

Briefly, in accordance with the invention, I provide an improved method to extract oil from a pool of oil in the ground. The method includes the step of providing an oil extraction apparatus. The extraction apparatus includes an elongate housing; at least one baffle wall (51) fixedly secured to said housing to pool oil during the operation of said oil extraction apparatus; and, a plurality of staggered, interconnected, rotatable units (42A, 42B). Each unit 42A, 42B includes a hollow cylindrical conduit having a first end and a second end; a first gear mounted on the first end; a second gear mounted on the second end; a drive shaft extending through the conduit; and, at least one helical blade attached to and extending about the drive shaft. The first gear (46) on a first one of the units (42A) engages the second gear (45) on a second one of the units (42D). The second one of the units is staggered from said first one of the units such that when the first one of the units rotates, the first gear rotates the second gear and the second unit. The first end of the first one of the units (42A) rotatably extends through the baffle wall (51). The second end of the second one of the is adjacent the baffle wall. The extraction apparatus also includes motive power to rotate the units (42A, 42D). The method includes the additional steps of boring an elongate canted opening in the ground at a selected angle from the horizontal; inserting the oil extraction apparatus in the bore such that a portion of the first one of the units is submerged in the pool of oil; and, operating said motive power to rotate said units (42A, 42D) such that oil from the pool travels up the first one of the units and pools adjacent the baffle wall (51), and oil pooling adjacent said baffle wall travels up the second one of the rotating units.

In another embodiment of the invention, I provide an improved method to extract oil from a pool of oil in the ground. The method includes the step of providing an oil extraction apparatus. The apparatus comprises an elongate housing; a plurality of interconnected, rotatable units (10, 12) each including a hollow cylindrical conduit having a first end, a second end, a drive shaft extending through the conduit, and at least one helical blade attached to and extending about the drive shaft; and, motive power to rotate the units (10, 12). The method also includes the steps of boring an elongate canted opening in the ground at a selected angle from the ground; inserting the oil extraction apparatus in the bore such that a portion of the first one of the units is submerged in the pool of oil; and, operating the motive power to rotate the units (10, 12) such that the helical blades carry oil upwardly from the pool.

Figure 1:
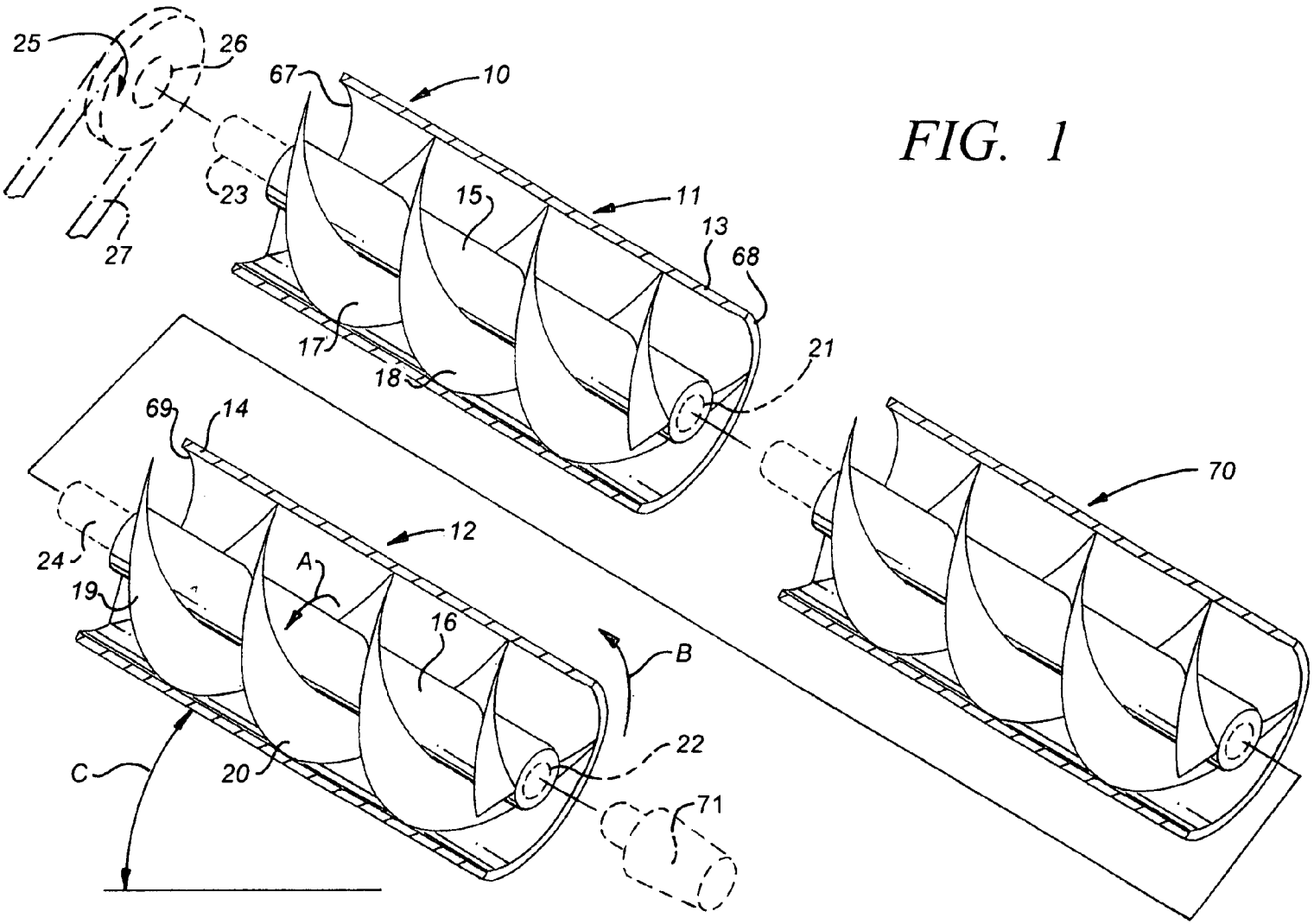
FIG. 1 is a perspective exploded assembly section view illustrating an oil extraction apparatus constructed in accordance with the invention.

Turning now to the drawings, which depict the presently preferred embodiments of the invention for the purpose of illustration thereof, and not by way of limitation of the invention, and in which like characters refer to corresponding elements throughout the several views, FIG. 1 illustrates one embodiment of the invention comprising oil extraction apparatus generally identified by reference character 10.

Oil extraction apparatus 10 includes units 10 and 12, pulley 25, and continuous belt 27 operated by a motor (not shown) to provide the motive power utilized to power apparatus 10.

Units 10 and 12 are identical in shape, dimension, and construction, although this need not be the case.

Unit 10 includes hollow cylindrical housing 11, drive shaft 15, a first helical blade 17 circumscribing and fixedly connected to shaft 15, and a second helical blade 18 circumscribing and fixedly connected to shaft 15.

Unit 12 includes hollow cylindrical housing 14, drive shaft 16, a first helical blade 19 circumscribing and fixedly connected to shaft 15, and a second helical blade 20 circumscribing and fixedly connected to shaft 15.

An internally threaded aperture 21, 22 can be formed in one end of a shaft 15, 16, respectively. An externally threaded nose 23, 24 can be formed at the other end of a shaft 15, 16, respectively. Each nose 23, 24 is shaped and dimensioned to turn into an aperture 21 or 22, or, to turn into an internally threaded aperture 26 formed in a pulley 25.

Units 11 and 12 are connected such that circular lip 68 of unit 11 contacts and is in registration with circular lip 69 of unit 12. One method of interconnecting units 11 and 12 is to turn nose 24 into internally threaded aperture 21 until lip 68 and 69 contact one another.

A drive shaft 15 and blades 17, 18 can rotate inside a housing 11. Alternatively, blades 17 and 18 can be fixedly secured to housing 11 such that housing 11, shaft 15 and blades 17 and 18 rotate simultaneously. Further, a shaft 15 and one or more helical blades mounted on shaft 15 can be utilized without a housing 11. For sake of the following discussion concerning use of the apparatus of FIG. 1, it is assumed that the housing 11, 12 of each unit 11 and 12 is utilized and that blades 17, 18, 20, 21 and shafts 15 and 16 turn freely inside their respective housing 11, 12.

As is shown in FIG. 1, one or more auxiliary units 70 can be interposed between and in alignment with units 11 and 12 to increase the length of the apparatus of FIG. 1. Unit 70 is identical in shape, dimension, and construction, to units 11 and 12, although this need not be the case. In addition, a conically shaped nose 71 can be attached to the lower end 70 of unit 12. Nose 71 preferably, but not necessarily, includes one or more peripheral helical blades (not shown) which extend around nose 71 in the same manner that blades 17 and 18 extend around shaft 15 and which can assist in carrying oil to blades 19 and 20. Nose 71 can provide ingress into a pool of oil and can rest against the bottom of a bore to assist in stabilizing apparatus 10 in position in the bore.

In use of the apparatus of FIG. 1, a sloped aperture is drilled in the earth to extend from the surface of the ground down to a desired subterranean pool of oil. The cant of the aperture from the horizontal is indicated by arrow C in FIG. 1 and typically is in the range of fifty to sixty degrees, although the slope can vary as desired. Vertically orienting units 11 and 12 (and therefore shafts 15 and 16) is not practical in the practice of the invention. Similarly, if angle C is in the range of one degree to twenty degrees or to thirty degrees, such is not practical because the blades 17, 18, 19, 20 will not effectively move oil or because the length of aperture required to reach a pool of oil is prohibitively long. Likewise, if angle C is in the range of seventy to ninety degrees, such is not practical because the blades 17 to 20 do not effectively raise oil toward the surface of the ground when units 11 and 12 are canted at such a severe angle.

After the aperture is bored (or simultaneously while the aperture is bored), units 11 and 12 are mounted in the aperture so that the lower end 70 of the extraction apparatus 10 is sufficiently submerged in a pool of oil such that simultaneously rotating shafts 15, 16 and blades 17 to 20 causes oil to move upwardly first along blades 20 and 19 and then upwardly along blades 18 and 17. A motor (not visible in FIG. 1) is used to turn belt 27, which turns pulley 25 mounted on nose 23 and, as a result, turns shafts 15 and 16. The rotation of shafts 15 and 16 and blades 16 to 20 caused oil to move upwardly on blades 17 to 20 from the lower end 70 upwardly toward upper end 67, and out end 67 into a reservoir.

In an alternate embodiment of the invention, after a sloped aperture is formed in the ground, a hollow cylindrical oil well casing is inserted in the bore, after which the apparatus of FIG. 1 (or FIG. 2) is slidably inserted in the casing.

Figure 2:
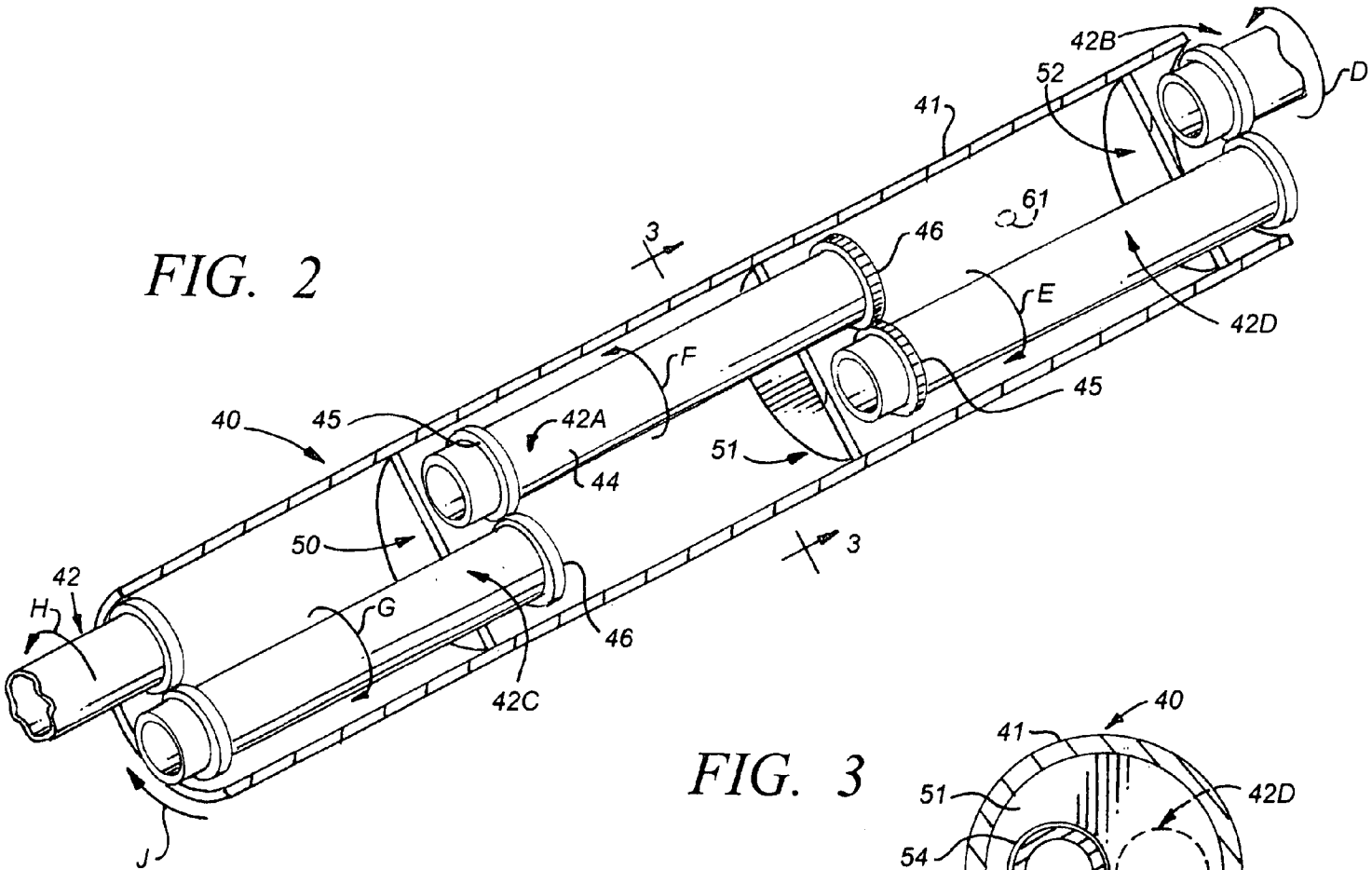
FIG. 2 is a perspective section view illustrating an alternate oil extraction apparatus constructed in accordance with the invention.
Figure 3:
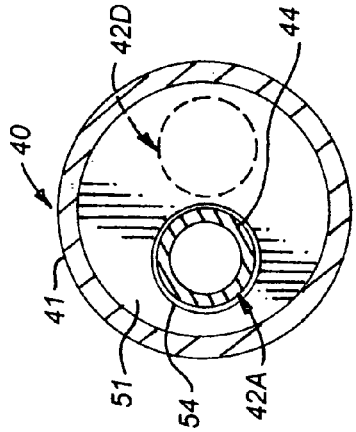
FIG. 3 is a section view of the apparatus of FIG. 2 taken along section line 3-3 thereof and illustrating additional construction details; and, FIG. 4 is a side section view of the apparatus of FIG. 2 illustrating the mode of operation thereof.
Figure 4:
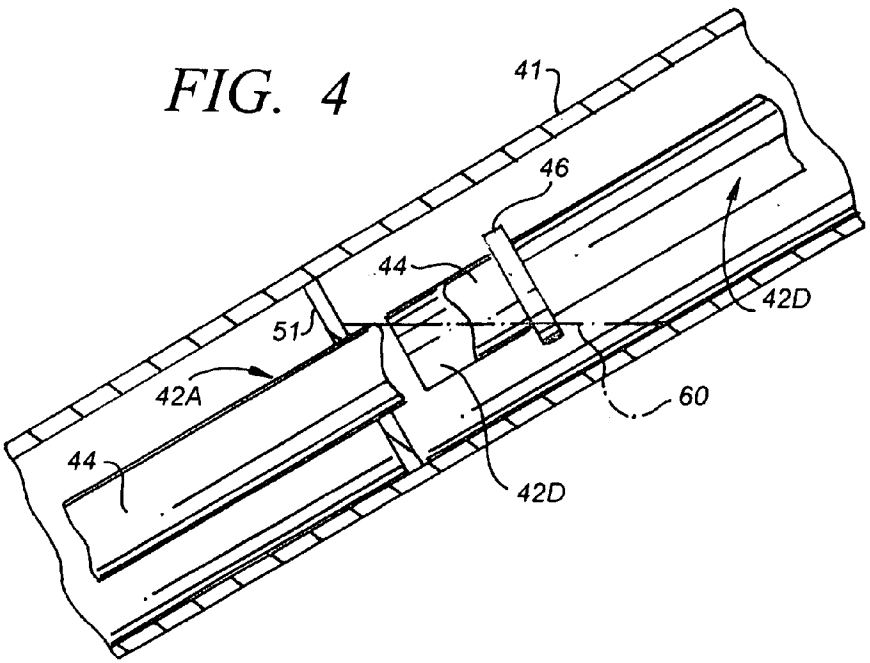

An alternate embodiment of the invention is illustrated in FIGS. 2 to 4. The oil extraction apparatus of FIGS. 2 to 4 is generally indicated by reference character 40 and includes a hollow cylindrical housing 41 and a plurality of spaced-apart circular baffle plates 50 to 52 fixedly mounted inside housing 41.

Each of the staggered, interconnected, rotatable units 42, 42A, 42B, 42C, 42D is of equivalent shape, dimension, and construction, although this need not be the case. Each rotatable unit 42, 42A, 42B, 42C, 42D includes a hollow cylindrical housing 44 with first end with a toothed or other gear member (for example, the gear member might simply be a cylindrically shaped rubber sleeve extending around the first end) 46 fixedly attached thereto and with a second end with a toothed or other gear member 45 fixedly attached thereto. Units 42, 42A, etc. are arranged along the interior of housing 41 in staggered, or offset fashion, in the manner shown in FIG. 2 so that each gear 46 on one end of a first unit 42, 42A, etc. is, except at the upper and lower ends of the apparatus 40, in contact with a gear 45 on the end of a second unit 42, 42A, etc. that is offset from the first unit. For example, in FIG. 2, the gear 46 on one end of unit 42A contacts the gear 45 on one end of unit 42D. Unit 42D is staggered or offset from unit 42A. The helical blade or blades mounted inside each housing 44 are fixedly attached to the housing such that the housing 44 and blade rotate simultaneously.

In FIG. 2 only one end of units 42B is visible. The other end of unit 42B which is not shown in FIG. 2 is connected to a pulley and belt (or the desired motive power means) in a manner similar to the pulley 25 and belt 27 of FIG. 1. The belt is turned by a motor (not shown). The belt turns the pulley and unit 42B in the direction of arrow D (FIG. 1), which in turn turns unit 42D in the direction of arrow E, which in turn turns unit 42A in the direction of arrow F, which in turn turns unit 42C in the direction of arrow G, which in turn turns unit 42 in the direction of arrow H. The lower end of unit 42 is, in use, at least partially submersed in a pool of oil so that oil travels up rotating unit 42 and out the upper end of unit 42 into a pool formed behind a baffle plate (not visible in FIG. 2). The lower end of unit 42C is at least partially submersed in the pool. Oil in that pool then travels up rotating unit 42C and out the upper end of unit 42C to form a pool behind baffle plate 50. The lower end of unit 42A is at least partially submersed in the oil pool behind baffle plate 50. Oil from the pool behind baffle plate 50 travels up rotating unit 42A and out the upper end of unit 42A to form a pool of oil 60 (FIG. 4) behind baffle plate 51. As is depicted in FIG. 4, the lower end of unit 42D is at least partially submersed in pool 60. Oil from the pool 60 travels up rotating unit 42D and out the upper end of unit 42D to form a pool behind baffle plate 52. The lower end of unit 42B is at least partially submersed in the oil pool behind plate 52. Oil in the pool behind plate 52 travels up rotating unit 42B and out the upper end (not visible) of unit 42B into a reservoir or other desired containment or processing system.

In FIG. 2, the housing 41 and units 42, 42A, 42B, etc are viewed in an orientation in which housing 41 and units 42, 42A, 42B have been rotated about thirty degrees from their normal orientation in the direction of arrow J. When housing 41 and units 42, 42A, 42B, etc are in their normal presently orientation, the longitudinal axes of housing 41 and units 42, 43A, 42B each lay in a common flat plane that is parallel to the longitudinal axis of the aperture that is drilled in the ground and that is perpendicular to a vertical plane extending downwardly through the longitudinal axis of the aperture. The vertical plane is normal to the horizontally oriented upper surface of the ground. Such an orientation is presently preferred because it places the upper end of unit 42 and the lower end of unit 42 in the orientation illustrated in FIGS. 3 and 4. The orientation illustrated in FIGS. 3 and 4 facilitates the delivery of oil by unit 42A into pool 60, and facilitates immersing the lower end of member 42D sufficiently to permit the helical blade in member 42D to carry oil upwardly out of pool 60. FIG. 4 is a side view of a portion of the apparatus 40 of FIG. 2 when the apparatus 40 is in its preferred orientation in a bore in the ground. In FIG. 4, units 42A and 42D are in a "side-by-side" orientation and are not stack one on top of the other. One or more openings 61 (FIG. 2) can be formed in housing 41 at desired locations therealong to relieve pressure that may builds up in housing 41. An opening 61 can house a one-way pressure relief valve which allows matter to flow outwardly from inside housing 41 and does not permit material to flow into housing 41 through the pressure relief valve. Or, such a pressure relief valve can only permit matter to flow into, and not out of, housing 41.

In one embodiment of the invention, one or more of the units 42,42A, 42B, etc. do not include a housing 44, but instead simply include a drive shaft and one or more helical blades mounted on the drive shafts. Gears or other means are mounted on the upper and lower ends of the drive shafts so that turning one of the drive shafts transmits motive power to and turns the remaining ones of the chain of staggered drive shafts. The drive shafts are offset from one another in the same manner that units 42, 42A, 42B, etc are offset from one another in FIG. 2. Similarly, in FIG. 1, housings 13 and 14 can be omitted and only the drive shafts and helical blades utilized.

Each unit 42, 42A, 42B, etc. presently preferably includes within housing 44 a drive shaft and at least one helical blade fixedly mounted on the drive shaft in the same manner as the drive shafts 15, 16 and blades 17 to 20 in FIG. 1. Each helical blades is fixedly secured to and rotate simultaneously with its associated housing 44. The drive shafts and helical blades are omitted from FIGS. 2 to 4 for sake of clarity.

In use of the apparatus of FIGS. 2 to 4, a sloped aperture is drilled in the earth to extend from the surface of the ground down to a desired pool of oil. The cant of the aperture from the horizontal typically is, as noted, in the range of fifty to sixty degrees, although the slope can vary as desired.

After the aperture is bored, the extraction apparatus 40 of FIG. 2 is mounted in the aperture so that the lower end of the apparatus 40 and of unit 42 is sufficiently submerged in a pool of oil such that simultaneously rotating units 42, 42A, 42B, etc causes oil to move upwardly through units 42, 42A, 42B, etc and from the oil pool behind one baffle plate to the oil pool behind the next higher baffle plate until oil reaches the upper end of apparatus 40 and of unit 42B. A motor (not visible in FIG. 1) is used to turn a belt or other mechanism that rotates unit 42B in the direction of arrow D, which then causes the remaining units 42, 42A, 42C, 42D to turn in the directions indicated by arrows H, F, G, and E, respectively. The rotation of the helical blades in units 42, 42A, 42B, etc. (simultaneously with the rotation of housings 44) causes oil to move upwardly through units 42, 42A, 42B, etc.

In FIGS. 2 to 4, the upper ends of units 42C, 42A, 42D each extend through an opening 54 formed in a baffle wall 50, 51, 52. If desired, a bushing can be mounted in opening 54 to receive rotatably the cylindrical end of a unit 42C, 42A. 42B. Unless the upper end of a unit 42, 42A, 42B, etc. is at the very bottom or very top of apparatus 40, it is rotatably supported by and mounted in a baffle plate. In FIG. 2 the lower ends of each unit normally are not mounted in a baffle plate but can, if desired, be so mounted, in which case appropriate openings would need to be formed in the lower end of the housing 44 to permit oil to flow into the interior of the housing and be transported upwardly by the helical blade in the housing.

Having described the invention and presently preferred embodiments and the best modes thereof in such terms as to enable one of skill in the art to make and use the invention, I claim:

1. A method to extract oil from a pool of oil in the ground, comprising the steps of (a) providing an oil extraction apparatus comprising
  (i) an elongate housing;
  (ii) at least one baffle wall (51) fixedly secured to said housing to pool oil during the operation of said oil extraction apparatus,
  (iii) a plurality of staggered, interconnected, rotatable units (42A, 42B) each including
    a hollow cylindrical conduit having
      a first end,
      a second end,
    a first gear mounted on said first end,
    a second gear mounted on said second end,
    a drive shaft extending through said conduit,
    at least one helical blade attached to and extending about said drive shaft,
    said first gear (46) on a first one of said units (42A) engaging said second gear (45) on a second one of said units (42*d*) staggered from said first one of said units such that when said first one of said units rotates, said first gear rotates said second gear and said second unit,
    said first end of said first one of said units (42A) rotatably extending through said baffle wall (51),
    said second end of said second one of said units adjacent said baffle wall
  (iv) motive power to rotate said units (42A, 42D);
(b) boring an elongate canted opening in the ground at a selected angle from the ground;
(c) inserting said oil extraction apparatus in the bore such that a portion of said first one of said units is submerged in said pool of oil; and,
(d) operating said motive power to rotate said units (42A, 42B) such that
(i) oil from said pool travels up said first one of said units and pools adjacent said baffle wall (51), and
(ii) oil pooling adjacent said baffle wall travels up said second one of said units.

* * * * *